United States Patent [19]

Gowdy

[11] 3,983,644

[45] Oct. 5, 1976

[54] FLASH/FLOODED BOILER STEAM IRON

[75] Inventor: Harold W. Gowdy, Ontario, Calif.

[73] Assignee: General Electric Company, Bridgeport, Conn.

[22] Filed: Dec. 3, 1975

[21] Appl. No.: 637,121

[52] U.S. Cl. ..... 38/77.83

[51] Int. Cl.[2] ..... D06F 75/06

[58] Field of Search..... 38/77.1, 77.5, 77.7, 38/77.8, 77.81, 77.83, 77.9

[56] References Cited

UNITED STATES PATENTS

| | | | |
|---|---|---|---|
| 3,156,054 | 11/1964 | Davidson | 38/77.81 |
| 3,703,043 | 11/1972 | Ogata et al. | 38/77.83 |
| 3,747,241 | 7/1973 | Davidson | 38/77.83 |
| 3,896,572 | 7/1975 | Jeffress | 38/77.83 |

*Primary Examiner*—Patrick D. Lawson

*Attorney, Agent, or Firm*—John F. Cullen; George R. Powers; Leonard J. Platt

[57] ABSTRACT

A combination flash/flood boiler steam iron with a water tank having a fill opening and a liquid fill valve means to close the tank to ambient and having a steam generating soleplate with ports and boiler therein and a water valve to start and stop a metered flow of water to the boiler for generating flash steam. In this combination the improvement is added for selectively operating the iron with a flooded boiler comprising a separate flood valve means operable to partially empty the tank and fill the boiler to a flooded condition to generate saturated steam. A tubular means connects the boiler and water tank to balance both pressure within the iron and water level during flooded operation and to conduct all the generated steam to the tank interior. A steam passage distributing means connects to the soleplate ports and the distributing means is separated from the boiler generating means. Pressure control conduit means connects the tank interior and the distributing means whereby the iron operates dry with the valves closed to prevent steam generation; it operates with flash steam with the water valve open; and it operates flooded with saturated steam with the flood valve open; thus providing flexibility in several modes of operation. Additionally, a removable spout may be attached to the fill opening forming a steam nozzle so the iron may be used as a fabric steamer on vertically hanging garments.

7 Claims, 2 Drawing Figures

FLASH/FLOODED BOILER STEAM IRON

BACKGROUND OF THE INVENTION

1. Field of the Invention

The invention is a combination flash/flooded boiler system steam iron providing ironing flexibility and multimodes of operation by taking advantage of two well-known and separate types of operating systems.

2. Description of the Prior Art

There are generally two well-known and separate systems of steam irons and these are the flooded boiler and the flash boiler and irons are usually one version or the other. The flooded boiler is not widely used in this country but is used abroad. It allows water to drip into a soleplate steam boiler at a rate greater than the rate at which steam is formed so fills or floods the boiler. Once the boiler is flooded, the steam rate varies with the temperature setting of the iron since more water can be boiled away as steam at high temperature settings than at low temperature settings. When operating flooded, the steam is formed in the boiler like a teakettle at the boiling temperature (212°F at sea level) and is separated from the boiler water and directed first into the tank and then ducted out the soleplate. A typical flooded boiler steam iron is shown in U.S. Pat. No. 3,156,054 of a common assignment.

The flash boiler system flashes the water immediately into steam and has the advantage of providing very quick steam operation after starting with a cold iron. However, to accomplish rapid flash steaming it is necessary to have sufficient heat storage in the metallic components in which the steam is generated and delivered or the steam merely condenses. Thus, the steam is typically relatively dry and substantially above the water boiling temperature. This steam may not be as satisfactory as a wetter lower temperature or saturated steam for moistening some fabrics since it does not condense as readily on the fabric to assist in ironing. Also, its steam rate does not vary with the temperature setting since it is a function of the sizing of the metering apparatus. This flash system has been particularly successful commercially in this country.

A simple and inexpensive iron using advantages of both the flooded boiler and the flash boiler to provide selectively both wet or saturated steam when operating in a flooded mode and dry super-heated steam when operating in a flash mode is disclosed in U.S. Pat. No. 3,896,572, also of common assignment. While workable, because of using the same water valve to provide different rates of flow as shown in FIGS. 2*b* and 2*c* of the 3,896,572 patent, some sealing problems were encountered with the fill valve at the top of the tank downstream of the fill opening through which the iron is filled with water. Because of the need to seal the fill opening at two vertically different positions to obtain the two rates of flow of water through the metering valve as shown in FIGS. 2*b* and 2*c* while opening the liquid fill valve when the metering valve is closed as in FIG. 2*a* or trying to seal in two vertical positions, the 3,896,572 patent is difficult to manufacture.

Thus, both flash and flooded boiler irons separately are well known, A combination flash/flooded boiler iron is disclosed in the above 3,896,572 patent. The present invention is a modified combination of the 3,896,572 patent to overcome the sealing problems and retain the advantages and provide an additional feature such as a vertical steamer.

SUMMARY OF THE INVENTION

Briefly described, the invention is a modification of the 3,896,572 patent being directed to a pressurized steam iron with a water tank having fill opening and liquid fill valve means to close the tank to ambient and having a steam generating soleplate with ports and a boiler and a conventional water valve to start and stop a metered flow of water to the boiler for generating flash steam. To this combination, the invention adds an improvement for selectively operating the iron with a flooded boiler that comprises a separate flood valve means operable to partially empty the tank and fill the boiler to generate saturated steam. Tubular means connects the boiler and tank for both balancing pressure within the iron and, during flooded operation, for balancing the water level in the boiler and the tank. Under all conditions of operation, the tubular means conducts the generated steam to the tank interior. A steam distributing means, separated from the generating means is connected to the soleplate ports for the exit of steam and a pressure control conduit connects the tank and distributing means so that all steam through the soleplate must pass through the tank first. The iron may operate dry with water and flood valves closed, it may operate with flash steam with the water valve open in a normal manner, and it may operate with saturated steam with its separate flood valve open and with the water valve open or closed to provide multi modes of operation. Additionally, a removable spout is provided for attachment to the fill opening so that, with the fill valve open, generated saturated steam may be directed out the nozzle for operating the iron in a substantially horizontal position as a steamer for vertically hangiing fabrics. Thus, the main object is to provide a modified form of flash/flooded boiler steam iron that also lends its structure easily to provide a steamer for vertically hanging garments.

DESCRIPTION OF THE PREFERRED EMBODIMENT

Figure 1:
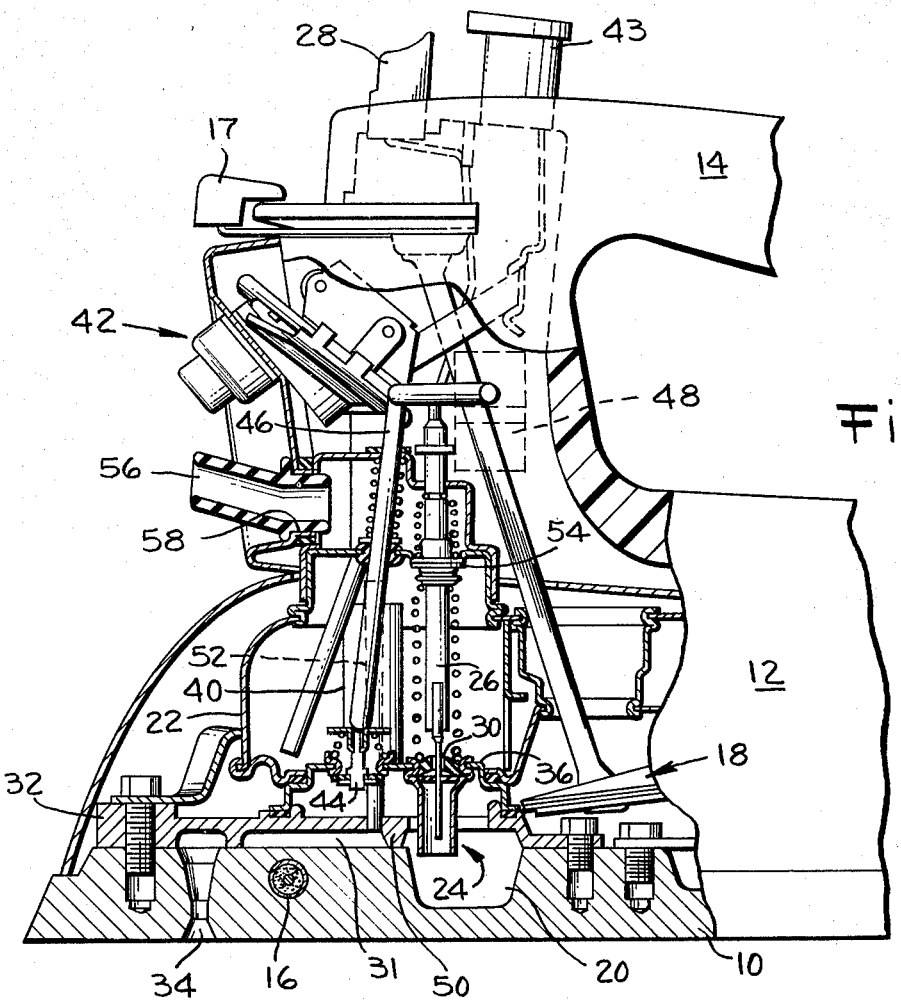
FIG. 1 is a side elevation, partially in section, showing the invention as applied to a steam iron.
Figure 2:
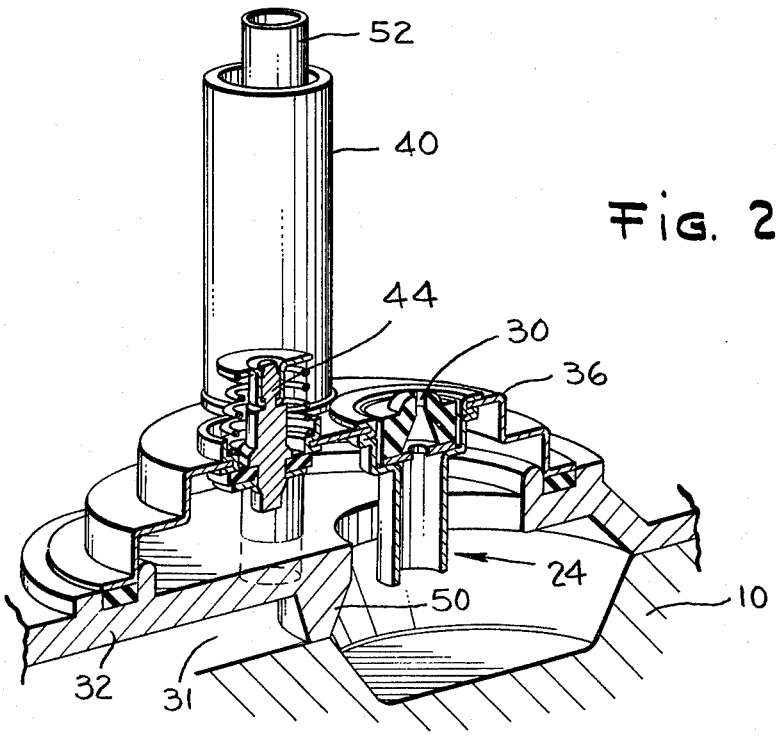
FIG. 2 is a perspective, partially broken away, of the flood and metering valves and steam distribution paths.

Referring to FIG. 1, a steam iron embodying the invention typically includes a soleplate 10, connected cover 12, and operating handle 14. In accordance with conventional practice, soleplate 10 may be cast from aluminum with an electrical heating element usually of the sheath type in which an electrical resistance 16 extends through a protective sheath with the heating element separated from the sheath by an insulating compound such as magnesium oxide. The entire heating element 16 is preferably cast into the soleplate. The temperature of the soleplate is set by control knob 17 connected to operate a thermostat, generally indicated at 18, all as well known in the art. Uniform heat is provided by extending the heating element 16 in a loop from the rear along one side of the soleplate to the forward end and then rearwardly along the other side.

For steam generation, soleplate 10 has a steam boiler 20 and a suitable water tank 22 supplies water thereto under control of metering water valve structure, generally indicated at 24, that includes a valve stem 26, suitably actuated by step button 28, through normal linkage to stop and start the metered flow of water through orifice 30 into the hot boiler 20 for generating flash steam in a conventional manner.

The operation of the metering water valve 24 is conventional and is fully explained in U.S. Pat. No. 3,496,661 of common assignment. Briefly, valve orifice 30 is closed when button 28 is latched in its down position to provide for dry ironing.

The steam iron in FIG. 1 has steam distribution means including passages 31 under coverplate 32 and steam ports 34 in soleplate 10. A steam collecting dome 36 is tightly sealed to coverplate 32 in any suitable fashion and also supports various components of the iron including the water valve 24 and a tubular means 40 in the form of a balance tube that connects with the boiler 20 and with the upper interior portion of the tank 22 to transmit pressure from the boiler to the interior of the tank.

In order to equalize pressure throughout the defined system, balance tube 40 extends above the water line in water tank 22 to ensure the same steam pressure in the upper portion of the tank as in the boiler 20. For greater flexibility, the iron may be operated as a spray iron with either power or manual spray systems as shown generally at 42 and operable by button 43 and both systems are well known. To this point, the iron is substantially identical in form and description to that disclosed in said U.S. Pat. No. 3,896,572. Such patent discloses an iron that combines two types of steam systems, flash and flooded boiler, in a unique manner to provide many advantages.

In accordance with the present invention, a modified combination is disclosed to selectively permit the iron to operate as a flash/flood boiler iron and to avoid some sealing difficulties involved in the 3,896,572 patented version. As described, the iron operates to produce flash steam in the normal fashion by metering water into boiler 20 where it is flashed into steam, and eventually passes out ports 34 in a manner that will be explained. In order to convert the iron into a flooded boiler operation water is dumped into the boiler faster than it can be flashed off to provide a "teakettle" type of steam generation with the boiler full of water. The steam is generated throughout the boiler, which, because it is full of water provides saturated steam which is desirable in many ironing conditions as fully explained in the 3,896,572 patent. As opposed to said patent where multiple flow rates are provided through the same metering water valve, the present invention provides flooded operation by a separate flood valve 44 that is a larger spring-biased valve, preferably in the bottom of the water tank 22 as shown, which is opened by depressing rod 46 by a side handle-mounted button 48 in much the manner of the dump valve 60 in U.S. Pat. No. 3,747,241 of common assignment. Preferably, separate handle-mounted buttons operate the flood and water valves. The mechanical structure is similar to the dump valve in said U.S. Pat. No. 3,747,241 patent but in a completely different combination herein for a different purpose and operating in a different manner. The flood valve 44 is sized to partially empty tank 22 when actuated to fill boiler 20 thus generating saturated steam in the well known flooded boiler operation as fully described in U.S. Pat. No. 3,156,054 supra. Water tank 22 cannot empty since there is no place for the water to go other than into boiler 20 where it must be boiled off as steam in order for additional water to enter the boiler. The water level rises in the boiler and up into balance tube 40 until it is balanced or equal to the water level in tank 22. Thus, the balance tube 40 also balances the water level during flooded operation in addition to conveying the steam to the upper portion of the tank.

In order to avoid water leakage through the soleplate ports and to provide that all steam generated, whether flash or flooded, passes through the tank, the steam distributing means 31 is isolated or separated from the generating area in boiler 20 by providing coverplate 32 with wall 50 that seals on the inner surface of soleplate 10 separating the generating and distributing means so that no steam can pass directly from the boiler into distributing means 31 and to the ports. Thus, all steam generated passes up balance tube 40 into the upper portion of water tank 22 where it collects. To remove the steam and direct it to soleplate ports 34 for use, a pressure control conduit means 52 is provided and conveniently may be concentric in tube 40 and preferably is supported by the coverplate 32. It also extends well into the upper portion of the water tank and extends down through coverplate 32 in a sealing relation and into distributing means 31 to connect the two. Conduit 52 is described as a "pressure control" conduit meaning that it provides some resistance to flow in any suitable manner so that a slight pressure may be built up in the iron when liquid fill valve 54 is closed to ambient as shown in FIG. 1 whenever the iron is generating flash steam. This valve structure is conventional and fully described in U.S. Pat. No. 3,041,757 of common assignment and provides structure that permits a pressure bleed down before opening to fill and is well known. Since the iron described is designed to operate under only slight pressure, such as about ¼ psi, any suitable pressure control in conduit 52, such as an orifice, or even a circuitous flow through conduit 52, is sufficient to build up enough pressure. Thus, it will be seen that all generated steam can reach distributing means 31 only by passing into the tank interior and then down pressure control conduit 52. If flash steam is generated it is non-saturated since it simply accumulates in the top of tank 22 and then passes down conduit 52 as dry steam since it goes through no water. If saturated steam is generated during flooded operation, it also accumulates in tank 22 as wet steam and finds its way out through conduit 52 having passed through water in balance tube 40 to the level of the water in the tank. Any suitable means to separate water from the wet steam in flooded operation may be used as baffles and as such forms no part of the present invention except that steam only passes through conduit 52 by reason of its high takeoff in the tank.

Flooded operation provides a high steam rate at low temperature over a shorter period of time or, at the selection of the user, normal flash steam may be provided at a lower steam rate and higher temperature over a long period of time. Thus, the user has a choice in a single iron that she did not have before — the choice of constant filling for a high steam rate when operating flooded or a lower steam rate with fewer fillings when operating with flash steam. Because the openings of the balance tube 40 and return conduit 52 are above the free water surface during normal ironing or when the iron is on its heel rest, water cannot get into the steam distributing means 31 to cause soleplate flooding. If the iron is inadvertently stored on the soleplate with the water valve 24 open, no water will be able to reach the soleplate area.

In order to provide additional flexibility to the iron and convert it into a drapery/suit steamer where the soleplate is not used but the iron is held substantially in horizontal position or slightly tilted, a removably attached spout 56 may be provided to frictionally fit over fill opening 58 to provide a steam nozzle. Thus, when the iron is operating flooded, metering water valve 24 may be closed by button 28 thus opening liquid fill valve 54 and the saturated steam thus generated passes out spout 56 for use of the iron in steaming vertically hanging garments.

Summarized, the combination iron disclosed permits high flexibility and multi-operation in six modes as follows:

1. Dry - flood valve 44 and water valve 24 both closed - no steam is generated.

2. Normal Steam - water metering valve 24 open for generation of flash dry steam - slight pressure build up with liquid valve 54 closed.

3. Manual Spray - spray 42 operated by depressing button 43.

4. High Continuous Steam Rate - flood valve 44 and water valve 24 both open and temperature control 17 set at WOOL or above.

5. Steam at Low Temperature Settings - water valve 24 open, flood valve 44 open or closed - temperature control 17 set in PERM area.

6. Drapery/Suit Steamer - liquid fill valve 54 and flood valve 44 both open, water valve 24 closed, and spout 56 in position with temperature control 17 set at PRESS or above.

Thus, the invention is a different way of obtaining dual steam rates in a flash/flooded boiler iron without sealing problems and using a standard parts by adding an additional flood valve 44. This permits a standard water valve for a regular steam rate as a flash boiler plus a second larger flood valve for a higher steam rate as a flooded boiler and the addition of the spout provides a drapery/suit steamer attachment. This combination provides six modes of operation by the various combinations of control settings as noted above. Besides the three normal ironing modes of dry, steam, and spray, the iron has the additional features of high continuous steam rate, steam at low temperature settings, and a drapery/suit steamer.

While there has been described a preferred form of the invention, obvious equivalent variations are possible in light of the above teachings. It is therefore to be understood that, within the scope of the appended claims, the invention may be practiced otherwise than as specifically described, and the claims are intended to cover such equivalent variations.

I claim:

1. In a pressurized steam iron having a water tank with a fill opening and liquid fill valve means to close the tank to ambient, a steam generating soleplate with ports and boiler therein and a water valve to start and stop a metered flow of water to said boiler for generating flash steam, the improvement for selectively operating the iron with a flooded boiler comprising, a separate flood valve means operable to partially empty said tank and fill said boiler to generate saturated steam, tubular means connecting said boiler and tank for both balancing pressure within the iron and the water level during flooded operation and for conducting all generated steam to the tank interior, steam distributing means separated from the generating means and connected to the soleplate ports, pressure control conduit means connecting the tank and distributing means, whereby the iron operates dry with said valves closed, with flash steam with said water valve open, and with saturated steam with said flood valve open to provide multi modes of operation.

2. Apparatus as described in claim 1 having, a coverplate overlying said soleplate to define said steam distributing means therewith separate from the generating means, said conduit means extending from above the water level in said tank through said coverplate in sealing relation and into said distributing means.

3. Apparatus as described in claim 1 having spout means over said fill opening to provide a steam nozzle.

4. Apparatus as described in claim 1 having separate handle-mounted means for operating said water valve and said flood valve respectively.

5. Apparatus as described in claim 2 having separate handle-mounted means for operating said water valve and said flood valve respectively.

6. Apparatus as described in claim 2 having removable spout means attachable over said fill opening to provide a steam nozzle on said iron for vertical fabric steaming with said iron substantially horizontal.

7. Apparatus as described in claim 6 having separate handle-mounted means for operating said water valve and said flood valve respectively.

* * * * *

UNITED STATES PATENT AND TRADEMARK OFFICE

CERTIFICATE OF CORRECTION

PATENT NO. : 3,983,664

DATED : October 5, 1976

INVENTOR(S) : Ronald Martin

It is certified that error appears in the above-identified patent and that said Letters Patent are hereby corrected as shown below:

| | | |
|---|---|---|
| Col. 2, | Line 63 | Change "othewise" to --otherwise--. |
| Col. 3, | Line 37 | Change "rolles" to --rollers--. |
| Col. 4, | Line 53 | Change "reamins" to --remains--; |
| | Line 64 | Change "grapsed" to --grasped--. |
| Col. 5, | Line 9 | Change "4" to --24--; |
| | Line 29 | Change "premitting" to --permitting--; |
| | Line 68 | Change "workpice" to --workpiece--. |
| Col. 7, | Line 24 | Add (c) before "means for"; |
| | Line 27 | Add the word "plate" after "bearing"; |
| | Line 29 | Change "opening" to --open--. |

UNITED STATES PATENT OFFICE

CERTIFICATE OF CORRECTION

Patent No. 3,983,664 Dated October 5, 1976

Inventor(s) Ronald Martin

It is certified that error appears in the above-identified patent and that said Letters Patent are hereby corrected as shown below:

| | | |
|---|---|---|
| Col. 8, | Line 4 | Add (e) before "mounting"; |
| | Line 44 | Add semi-colon (;) after "rotate"; |
| | Line 60 | Change "adusting" to --adjusting--. |

Signed and Sealed this

Twenty-fourth Day of May 1977

[SEAL]

*Attest:*

RUTH C. MASON
*Attesting Officer*

C. MARSHALL DANN
*Commissioner of Patents and Trademarks*